United States Patent [19]

Butler, Jr. et al.

[11] 4,142,770

[45] Mar. 6, 1979

[54] SUBSEA ELECTRICAL CONNECTOR

[75] Inventors: Alfred Y. Butler, Jr., Bellair; Harold W. Clemons, Houston, both of Tex.

[73] Assignee: Exxon Production Research Company, Houston, Tex.

[21] Appl. No.: 864,295

[22] Filed: Dec. 27, 1977

[51] Int. Cl.[2] ..... H01R 13/52

[52] U.S. Cl. ..... 339/94 M; 339/112 L

[58] Field of Search ..... 339/94, 112 L, 117 R

[56] References Cited

U.S. PATENT DOCUMENTS

| | | | |
|---|---|---|---|
| 3,508,188 | 4/1970 | Buck | 339/117 R |
| 3,524,160 | 8/1970 | Robinson | 339/94 M |
| 3,729,699 | 4/1973 | Briggs et al. | 339/94 R |
| 3,750,088 | 7/1973 | Berian | 339/94 A |
| 3,845,450 | 10/1974 | Cole et al. | 339/94 M |
| 3,972,581 | 8/1976 | Oldham | 339/117 R |

FOREIGN PATENT DOCUMENTS

| | | | |
|---|---|---|---|
| 274176 | 9/1970 | U.S.S.R. | 339/94 R |

*Primary Examiner*—Joseph H. McGlynn
*Attorney, Agent, or Firm*—Salvatore J. Casamassima; Gary D. Lawson

[57] ABSTRACT

A subsea wet electrical connector capable of repeated mating and unmating underwater at great depths and capable of operating under conditions of continuous and simultaneous high amperages and high voltages up to 35,000 volts while mated. The connector employs cylindrical pin contacts in the male plug and a dummy piston and cylinder mechanisms in the female receptacle to protect the female contact prior to mating. Dielectric insulating blocks, preferably machined from polycarbonate, and a dielectric insulating fluid provide the electrical insulation for the conductive components of both the male plug and female receptacle. Passageways within the dielectric block of the female receptacle permit flow of dielectric fluid through the cylinder of the female receptacle during mating and allow convective circulation of the dielectric fluid through the cylinder to dissipate heat from the vicinity of the electrical conductors and solid insulating blocks.

11 Claims, 5 Drawing Figures

SUBSEA ELECTRICAL CONNECTOR

BACKGROUND OF THE INVENTION

1. Field of the Invention

This invention relates to electrical connectors. More particularly it relates to an improved subsea electrical connector designed to operate under sustained conditions of high voltage and high amperage.

2. Description of the Prior Art

With the recent rapid growth in development of natural resources in the offshore areas of the world it has become necessary to adapt and develop machinery and equipment for operation under water. An example of such an adaptation has been the development of subsea systems used for the production of oil and gas from offshore reservoirs. These systems are designed to handle a variety of tasks on the sea floor at water depths extending to several thousand feet. Such tasks may include well completions, oil and gas separation, pumping operations, flowline connections, and various maintenance tasks requiring diver or manipulator assistance. To provide the electrical power necessary to remotely operate the subsea systems, reliable electrical cables and connectors, operable at high voltages and currents, are required. Other examples of subsea machinery having high electrical power requirements are underwater construction and mining equipment, subsea work vehicles, and power transmission lines.

Most electrical connectors developed for underwater use must first be engaged above water before they can be submerged. Such connectors, known as "dry" connectors, are impractical where it is necessary to frequently mate and separate the connector. To do so requires bringing the connector to the surface each time a mating or disengagement is required. This procedure is especially impractical at great depths where a long length of cable must be brought to the surface in order to retrieve the connector.

Subsea connectors which may be safely connected or disengaged under water are referred to as "wet" electrical connectors. Typically, wet connectors have contacts that are sealed or protected from exposure to moisture or sea water. U.S. Pat. Nos. 3,491,326 (F. Pfister et al.) and 3,508,188 (J. R. Buck) disclose examples of disengageable connectors having protected contacts. Specifically, Pfister discloses a spring biased, hollow cylinder within the female receptacle half of a connector which shields the female contacts from the external environment when the connector is disengaged. When mated the male pin depresses the cylinder sufficiently so that the male contacts engage the female contacts. Seal rings positioned in front of the female contact serve to wipe any water or debris off the male pin as it enters the female receptacle. Buck et al. similarly discloses a slidable, piston-like sealing member biased by a spring which serves to protect the female contact until depressed by the male pin.

Wet connectors must also be capable of operating at depths where there exists a significant hydrostatic pressure exerted by the surrounding sea water. Sealing mechanisms such as those discussed above are capable of withstanding a limited hydrostatic pressure. Obviously, as the connector is subjected to greater differential pressures it becomes increasingly difficult to provide an effective sealing means having a sealing capacity in excess of the pressure differential. A pressure balanced connector such as that disclosed in U.S. Pat. No. 3,845,450 (J. C. Cole et al.) employs the use of a dielectric fluid which is present within both halves of the connector. A deformable plastic cable surrounding the dielectric fluid serves to pressurize the fluid to ambient pressure thereby eliminating any differential pressure across the fluid tight seals within the connector.

A design employing both a piston actuated sealing means and a dielectric oil pressure compensator is disclosed in U.S. Pat. No. 3,729,699 (E. M. Briggs et al.) and in OTC Paper 1976, "Development of an Underwater Mateable High-Power Cable Connector" by J. F. McCartney and J. V. Wilson (1974). The connector of Briggs et al. incorporates a dummy piston to seal the female electrical contact which is displaced by the male pin. A piston-cylinder hydraulic means is also used to pressure balance the internal pressure of the dielectric fluid with the external sea water pressure.

Although the design of wet electrical connectors, as described above, represents a considerable advance over dry connectors, the wet connectors developed to data have been limited in their power capacity. Presently, wet connectors have a maximum AC voltage limitation of about 4000 to 5000 volts AC RMS and a maximum amperage of about 100 amps. For all practical purposes, however, under conditions of continued submergence, high pressure and repeated matings, the connectors presently available have a sustained voltage limitation of about 1500 to 3000 volts AC RMS at 50 amps. Such power limitations for underwater connectors in turn limit the electrical power which can be made available to subsea equipment and machinery. There is, therefore, a need in the art for an underwater electrical connector capable of reliably operating at great depths while carrying a very high voltage with high current capacity.

SUMMARY OF THE INVENTION

The underwater wet electrical connector of the present invention overcomes the limitations of the prior art connectors and is capable of simultaneously carrying a sustained voltage of up to 35,000 volts and a current of up to 300 amperes under conditions of continued submergence. The connector is also capable of repeated matings and unmatings underwater. The connector includes the basic components of a male plug and female receptacle. The male plug includes one or more male pins which extend from the plug and which have on them a male contact which is usually mounted near the front of the pin. Entering the male plug is an electrical cable which terminates within the rear section of the male plug. Male electrical conductor means within the male pin provide an electrical conducting path from the electrical cable to the male contact.

Corresponding to the pins of the male plug are conductive cylinder means within the female receptacle which are adapted to receive each of the male pins. A female contact mounted within the conductive cylinder means mates with the corresponding male contact when the male pin is inserted into the cylinder means, thus providing an electrical conducting path from the male pin to the cylinder means. As with the male plug, an electrical cable terminates within the rear section of the female receptacle and connects with a female electrical conductor so as to provide a current path from the cable to the female conducting cylinder.

Mounted within each cylinder means is a nonconductive piston means which is maintained in an extended position within the cylinder means by a resilient means such as a spring when the male pin is not inserted in the cylinder means. When the connector is not mated, the piston means is fully extended and seals the entrance of the cylinder means. This sealing action prevents the entry of sea water and escape of dielectric fluid and thus protects the electrical integrity of the female contact. When the female receptacle and male plug are connected, the piston means is rearwardly displaced within the cylinder means by the male pin, thereby exposing the female contact to the male contact.

Insulating the conductive components of both the female receptacle and male plug are dielectric insulating blocks and dielectric fluid. The insulating blocks, preferably machined from polycarbonate plastic, are significantly superior to the elastomeric moldings normally used as dielectric insulation. The dielectric blocks insulate the male pin and male conductor in the male plug and the female contact, female conductor, and cylinder means in the female receptacle. A dielectric fluid, preferably a water immiscible liquid flourocarbon, is used to fill the void spaces of the male plug and female receptacle. Passageways bored through the dielectric block of the female receptacle are used to provide a continuous flow path from the rear of the female receptacle to the cylinder means. Such a flow path allows the dielectric fluid to be displaced during mating operations and permits the dielectric fluid to convectively circulate through the cylinder means to dissipate heat from the vicinity of the cylinder means.

DESCRIPTION OF THE PREFERRED EMBODIMENT

Figure 1:
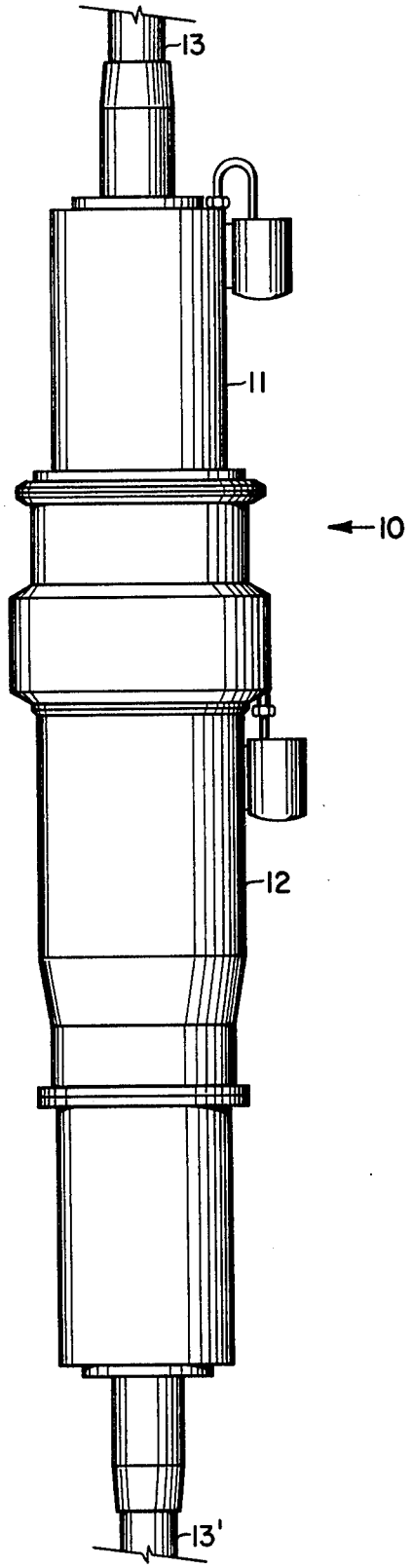
FIG. 1 is a side view of the electrical connector of the present invention when fully mated.

Referring to the drawings, FIG. 1 shows a side view of subsea wet electrical connector 10 as it appears fully mated. Connector 10 consists of two major components; namely, a female receptacle 11 and a male plug 12. Extending respectively from the ends of receptacle 11 and plug 12 are electrical cables 13 and 13'. Connector 10 is normally mated in the vertical position, as shown, with the female receptacle being above the male plug. As will be explained later, this particular orientation is preferred for mating the connector although any other orientation may be employed for connecting the male plug and female receptacle.

Figure 2B:
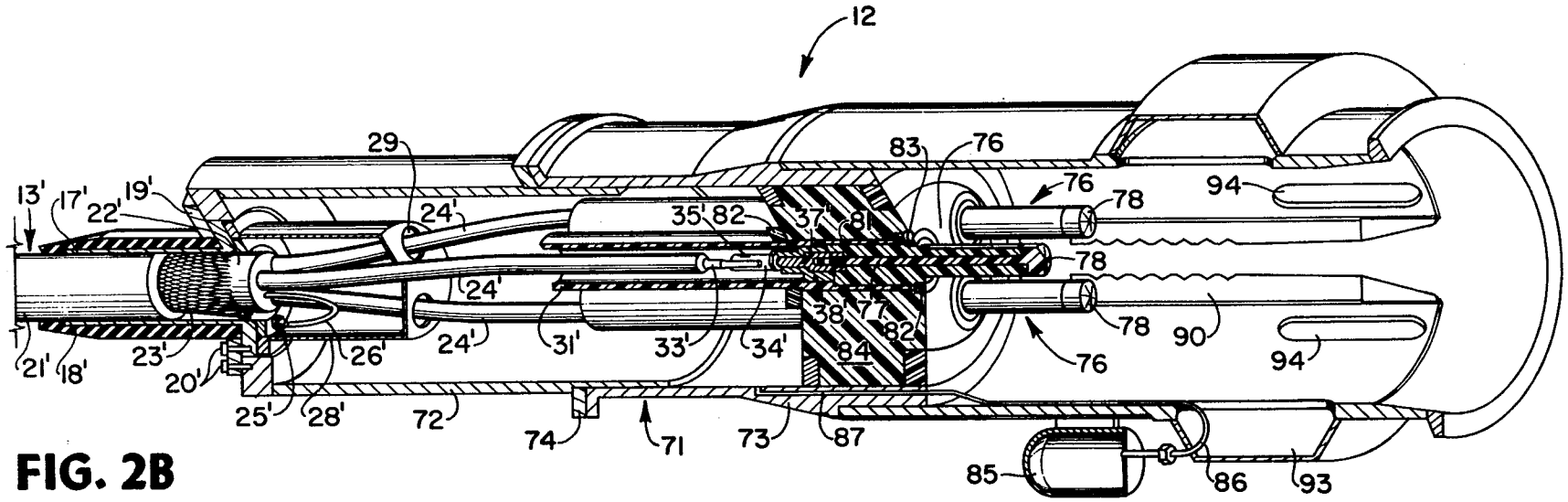
FIGS. 2A and 2B are sectional isometric views of the female receptacle and male plug components of the connector, respectively, shown in their unmated configuration.
Figure 2A:
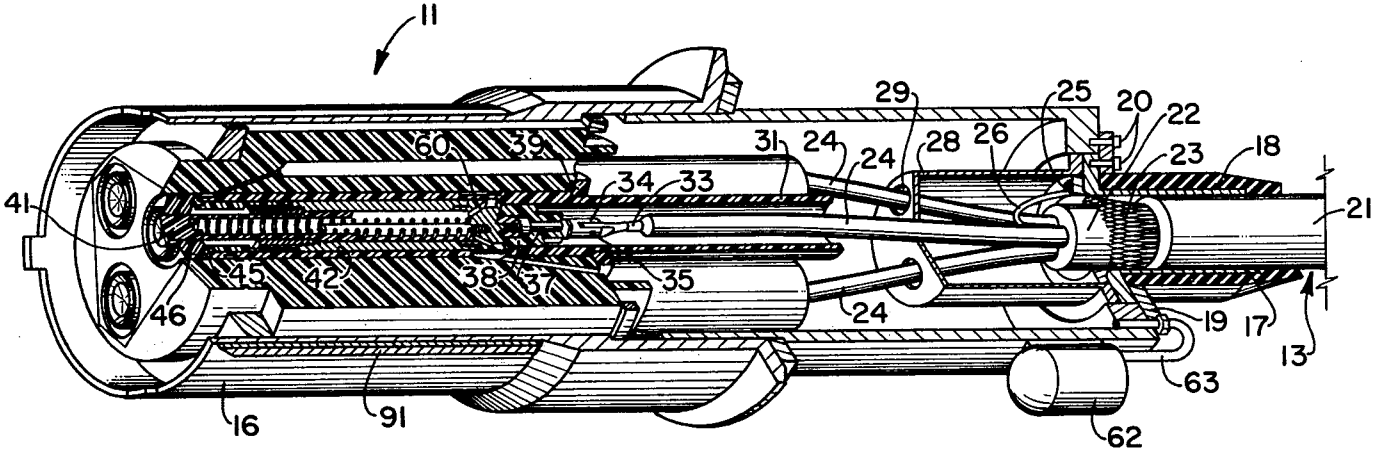

Referring now to FIGS. 2A and 2B, female receptacle 11 and male plug 12 are respectively shown in sectional views as they individually appear prior to being mated. Referring solely to FIG. 2A, female receptacle 11 consists of a steel housing 16 which envelopes the internal structure of the receptacle. Entering the top portion of housing 16 is electrical cable 13 and extending from housing 16 to receive cable 13 is cable termination cylinder 17. Tapered sleeve 18 is molded to cable 13 and termination cylinder 17 in order to provide strain relief and additional sealing for the terminal portion of cable 13. Sleeve 18 should be made of a high strength, abrasion resistant, flexible material such as polyurethane. Securing cylinder 17 in place is ring 19 which is fastened to the top portion of housing 16 by bolts 20.

Cable 13 consists of an outer jacket 21, an inner jacket 22, armor wire 23 and one or more insulated conductors 24. In the preferred embodiment described herein, three conductors are employed as shown in the views of FIGS. 2A and 2B. The conductors, armor wire and insulation are all covered by outer jacket 21. Inner jacket 22 is preferably made from a material that can be easily bonded such as neoprene or polyurethane. Armor wire 23 curves upwardly as it enters housing 16 where it is terminated and secured at its end to cable termination cylinder 17 by bolt 25. Also terminated at that point and secured by bolt 25 is ground wire 26. Insulated conductors 24, as they split off from cable 13, enter cable termination chamber 28 which is filled with an encapsulation compound. Ports 29 located at the base of chamber 28 direct the conductors into their respective conductor termination cylinders 31.

Each of the insulated conductors 24 which enter cylinder 31 are terminated by an exposed seamless, copper conductor connector 33. Conductor connector 33 is crimped at its ends and is connected by nut 34 and fitting 35 to terminal pin conductor 37. Surrounding pin conductor 37 is annular sleeve 38 which insulates the pin conductor. Preferably, sleeve 38 is made from machined polycarbonate. Also preferably made from polycarbonate are rings 39 which are employed as retainers to secure cylinders 31 in place.

Filling the void space within conductor termination cylinder 31 and within the top portion of housing 16 is a dense, dielectric fluid which provides high electrical isolation betwen conductors 23. A preferred dielectric fluid is one which would be compatible with all connector materials and which is denser than and immiscible with sea water. Useful dielectric fluids with such properties are liquid fluorocarbons. The fluorocarbon dielectric also serves as a lubricant for moving parts and O-ring seals within both the female receptacle and male plug. Being immiscible with water, the dielectric protects electrical components from sea water corrosion or contamination, thereby minimizing the possibility of a short circuit.

Figure 2C:
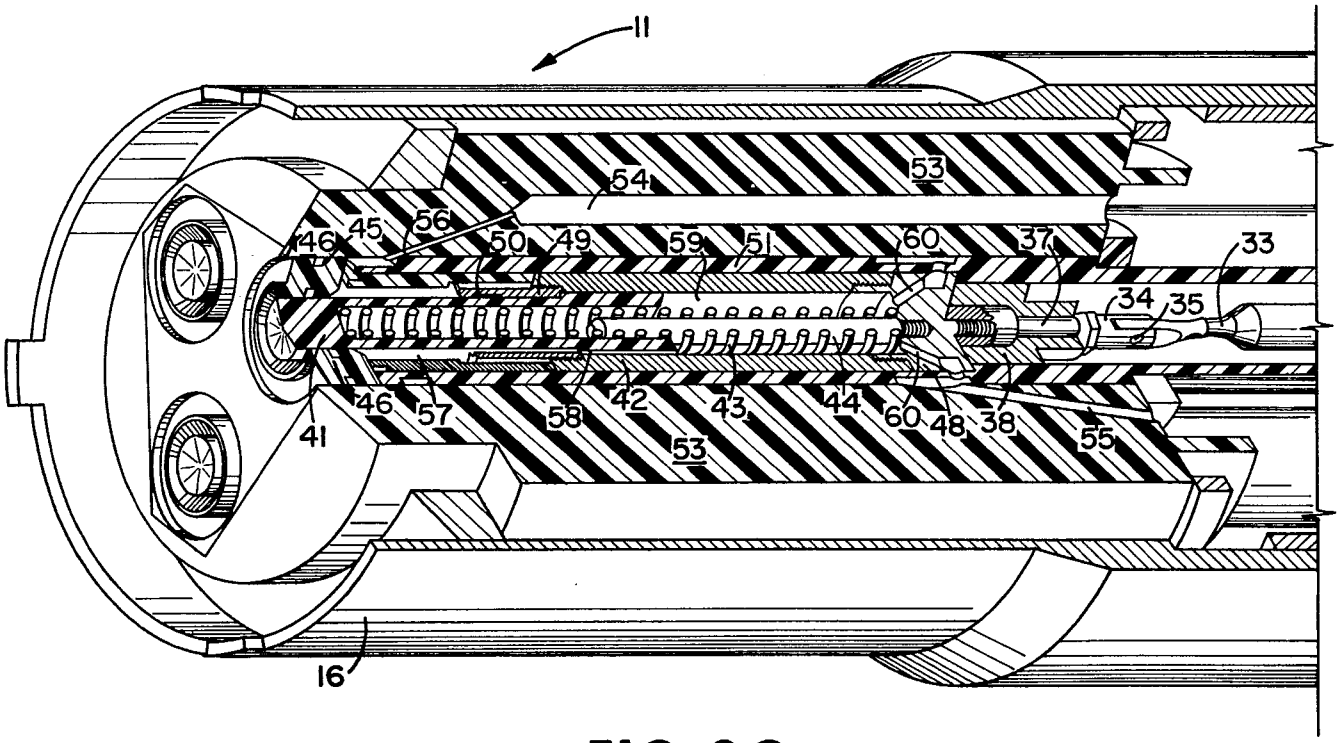
FIG. 2C is an enlarged sectional isometric view of the lower portion of female receptacle.

Reference is now made to the lower portion of female receptacle 11 which is depicted by the enlarged view shown in FIG. 2C. The receiving end of the receptacle which accommodates the male plug, contains a piston-cylinder arrangement corresponding to each conductor connector 33. The piston-cylinder arrangement includes a hollow dummy piston 41 housed within a conductor cylinder 42. Dummy piston 41, preferably constructed of a nonconductive hard plastic such as polycarbonate, is maintained in tension within conductor cylinder 42 by springs 43. Spring guide 44 centralizes springs 43 and receives dummy piston 41 as it recedes into cylinder 42. Positioned at the mating face of receptacle 11 are floating glands 45 which centralize the head of dummy pistion 41 and permit easier alignment of the male plug and female receptacle. Mounted within alignment gland 45 are O-rings 46, the function of which will be explained later.

Conductor cylinder 42, preferably constructed from a copper sleeve, is threadably secured at its upper end into cylinder cap 48 which is also made of copper. Cap 48, in turn, threadably inserts into terminal pin conductor 37 thus providing a continuum of current conduction from cable 13 to the end of cylinder 42. Threadably mounted on the end of cylinder 42 is contact block 49 which snugly fits around dummy piston 41 yet which permits the piston to slide within cylinder 42. Contact block 49 slightly projects from the inside of cylinder 42 and engages the shoulder of dummy piston 41, thereby preventing the piston from being pushed out of cylinder 42 by the compression of springs 43. Contact block 49 includes female contact 50 located on its inner surface. Female contact 50 is preferably a louvered sleeve having movable longitudinal slots or vanes which provide a tighter engagement with the male pin when it is inserted. Contact 50 may also be gold plated to maximize electrical conductivity to contact block 49.

Cylinder 42 is enclosed in an insulating sleeve 51 which is preferably machined from a hard, plastic dielectric such as polycarbonate. Encasing the insulating sleeves of the female receptacle is a single, insulating block 53. Insulating block 53 is preferably made of a strong, light-weight plastic dielectric which can be readily machined to close tolerances so as to provide a tight fit for the female receptacle components. Once again, polycarbonate is the preferred material because it is impact resistant, durable, readily machineable and resistant to chemical degradation or decomposition. Other types of insulators such as polyurethane and diallyl phthalate (DAP) are normally molded by pouring or injecting the unhardened insulating material into the female receptacle and male plug. However, molded elastomer insulators usually contain a large number of small void spaces which adversely affect the insulating ability of the dielectric. Under conditions of high voltage operation, air trapped within the void spaces undergoes a partial ionization creating a "corona" effect which permits destructive electrical discharge to occur within the insulator. A polycarbonate insulating block, by contrast, is machined from a solid piece of plastic which contains few internal void spaces or air pockets.

Machined within insulating block 53 are a series of bores 54, 55 and 56 which correspond to each cylinder 42. Bore 54 longitudinally extends from the upper portion of receptacle 11 to a point substantially within insulating block 53. Diagonally extending from the lower end of bore 54 is bore 56 which provides a fluid path through insulating sleeve 51 into annular space 57 surrounding dummy piston 41. Slot 58 within dummy piston 41 continues the fluid path into cylinder chamber 59. Finally, grooves 60 within cylinder cap 48 complete the fluid path by communicating with bore 55 which diagonally extends back into the upper portion of receptacle 11. Thus there exists a continuous fluid path from bore 54 through cylinder 42 and back to bore 55. As discussed below, such a continuous flow path is an important factor in the successful operation of the present invention.

During normal operation of a fully mated connector, significant quantities of heat may be generated and may build up, localizing in the vicinity of cylinder 42. Failure to dissipate such heat will impair performance of the connector and may ultimately result in the failure of internal components. The fluid flow path described above serves as a heat exchange medium for each cylinder 42. Heat generated within cylinder 42 will be dissipated to the dielectric fluid present in cylinder chamber 59 and natural convection currents will cause the heated dielectric fluid to rise up the cylinder chamber and out through groove 60 into bore 55 and from there into the upper portion of the female receptacle which contains the bulk of the dielectric fluid. Replacing the heated dielectric fluid is cooler fluid sinking into cylinder chamber 59 via bore 54 and notch 56. As a result of the natural convection circulation of the dielectric fluid, heat is continuously carried away from cylinder 42, thereby substantially contributing to the high current carrying capacity of the connector.

Referring back to FIG. 2A, the only component of female receptacle 11 that is external to housing 16 is bladder 62 which serves as a pressure balance compensator for the dielectric oil. As the connector is lowered into the sea, the external hydrostatic pressure of the surrounding sea water rapidly increases. As pressure on bladder 62 builds, dielectric fluid within the bladder is forced through tube 63 into the upper portion of receptacle 11. Since the dielectric fluid is essentially incompressible, the pressure of the dielectric fluid in receptacle 11 quickly equalizes with that of the sea water surrounding the bladder. Thus there is no tendency for the sea water to enter the receptacle because no pressure differential exists across housing 16.

Referring now to FIG. 2B, male plug 12 is shown consisting of a steel housing 71 having a back shell 72 and a front shell 73 which are secured together as a unitary piece by flange 74. Many of the components comprising male plug 12 correspond exactly to like parts in the female receptacle and therefore have been designated with the same reference numerals followed by a prime (′). Specifically, all components extending rearwardly from back shell 72, including all cable components, may be of the same construction as the female receptacle. Therefore, discussion of the male plug will begin with insulated conductor 24′ as it enters conductor termination cylinder 31′. As with the female receptacle, insulated conductor 24′ is similarly terminated by a seamless, copper conductor 33′, crimped at its end and connected by nut 34′ and fitting 35′ to terminal pin conductor 37′. Terminal pin conductor 37′ is enveloped by annular insulator 38′ which is preferably machined from polycarbonate.

Extending from the top of terminal pin conductor 37′ is male pin 76 which includes a copper or copper alloy male pin conductor 77 secured at one end within the base of terminal pin conductor 37′ and terminated at its other end by male contact 78. Male pin conductor 77, except for male contact 78, is encased within male pin insulator 79 which is preferably made from polycarbonate or another high strength dielectric. Each male pin 76 is contained within an insulating sleeve 81, also preferably machined from polycarbonate which is an extension of cylinder 31′. Insulating sleeve 81 and male pin 76 are secured in place by plastic rings 82 and nylon bolts 83 within insulating block 84. Where possible, connector components such as rings and bolts are constructed from nonconductive, nonmagnetic materials so as to minimize magnetic and conductive interference with current transmission through the connector and to maximize the tracking path for short circuits. Insulating block 84 is preferably made from polycarbonate.

Filling the void space within back shell 72 of the male plug is a suitable dielectric fluid such as a fluorocarbon. As with the female receptacle, dielectric fluid is pressure balanced by means of bladder 85 which communicates with the rear interior of the male housing 71 by tube 86 and bore 87. Bladder 87 performs in the same manner as bladder 62 by equalizing the external sea water pressure with the pressure within the male plug.

Referring now to both FIGS. 2A and 2B, front shell 73 of male housing 71 is open to the sea when the male plug and female receptacle are not connected. As male plug 12 and female receptacle 11 are mated the lower portion of housing 16 of the female receptacle slides into front shell 73 of the male plug. Located on the interior of shell 73 are alignment guide rails 90 which serve to orient the male plug and female receptacle as they are joined along a common axis to ensure proper mating of male pin 76 with dummy piston 41. Housing 16 of the female receptacle is provided with alignment ribs 91 which engage alignment guide rails 90 as the connection is being made.

As indicated previously, the male plug and female receptacle are preferably mated in a vertical position with the receptacle located above the male plug. The purpose of such an alignment is to immerse male pins 76 in a dense dielectric fluid prior to mating. With the male plug vertically positioned below the female receptacle, the dense dielectric will surround the male pins protecting them from the corrosive effect of sea water so long as the male plug remains unconnected. In addition to being denser than sea water, the dielectric fluid should also be immiscible with the sea water. When the male plug is connected, the dense dielectric fluid is displaced by the female receptacle and flows into concentric reservoir 93 through ports 94. If the male plug is subsequently disconnected dielectric fluid will flow out of the reservoir ports 94 and will gravitate back to the male pins.

When mating male plug 12 and female receptacle 11, male pin 76 contacts dummy piston 41 and pushes it back into cylinder 42. The convex top of male contact 78 is conically shaped and smoothly mates with the corresponding concave face of dummy piston 41 so as to effectively form a continuous rod. During mating, as male pin 76 slides through O-ring 46, any sea water residing on the male pin will be wiped off by the O-ring as it pushes through. As dummy piston 41 is pushed back into cylinder 42, dielectric fluid present in the cylinder will be displaced through groove 60 into the upper portion of the female receptacle.

With reference to the connecting ends of the male plug and female receptacle shown in FIGS. 2A and 2B, three male pins 76 are shown which correspond to dummy pistons 41 and floating glands 45 of the female receptacle. The connector body, namely male housing 71 and female housing 16, serves as the fourth conductor, eliminating the necessity for a fourth male pin and corresponding female conductor to achieve a grounded three phase AC system. A three pin - three conductor connector increases the insulating space within the male plug and female receptacle, thereby enhancing the overall electrical integrity of the connector. Mating of the connector is also simplified with a three pin connection, preventing mismatching of electrical phase conductors.

Figure 3:
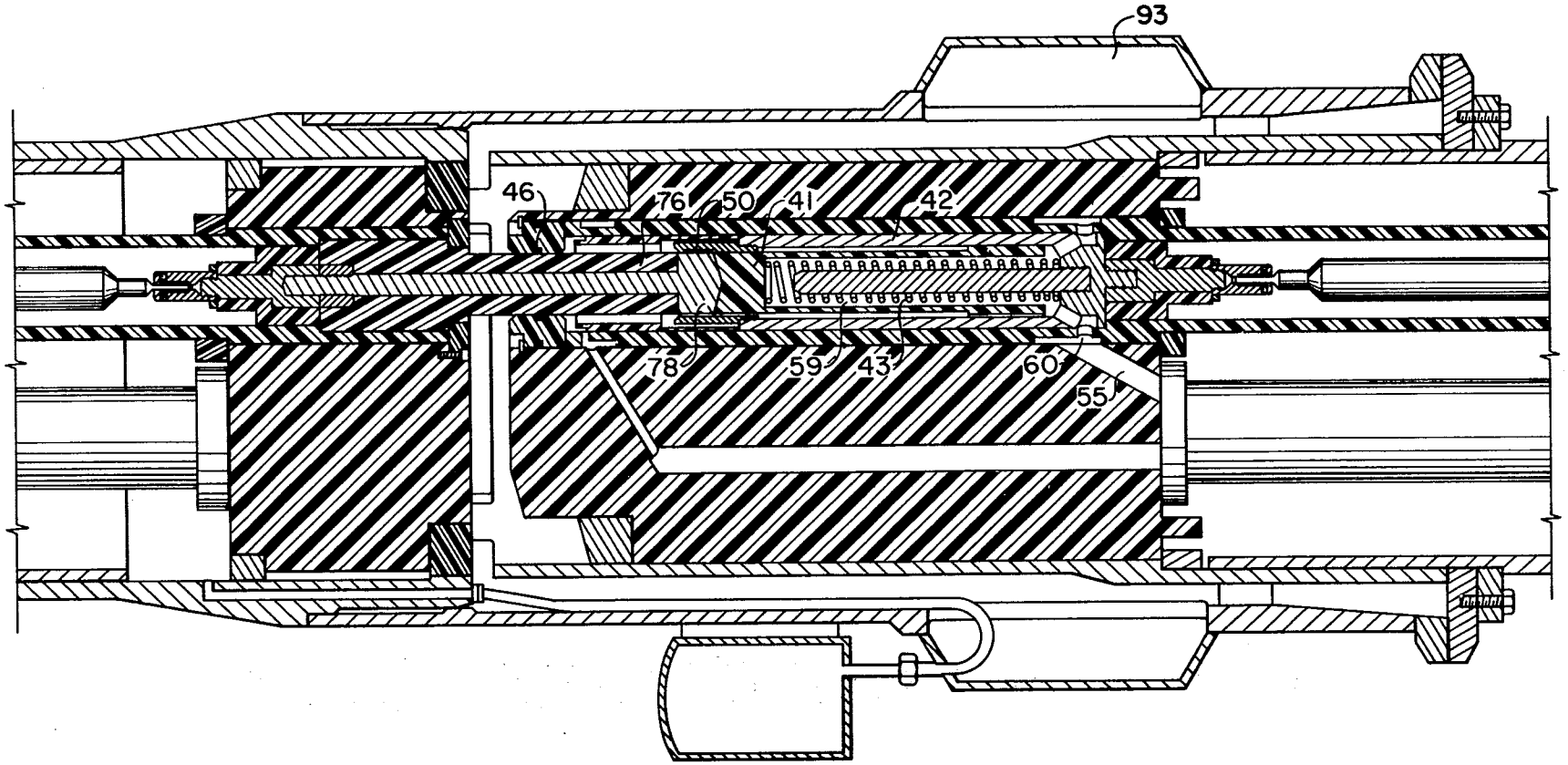
FIG. 3 is a partial cross-sectional view of the connector when fully mated.

Reference is now made to FIG. 3 which cross-sectionally shows the mating portions of the male plug and female receptacle when fully connected. As shown, male pin 76 sufficiently displaces dummy piston 41 so that male contact 78 engages female contact 50, thereby completing the circuit. With the connector aligned in a vertical position, should any sea water enter cylinder chamber 59, the dense dielectric fluid in the chamber will quickly displace the sea water and cause it to rise within the chamber away from the vicinity of the male and female contacts. As mentioned previously, natural convection currents will cause the dielectric fluid to circulate within the female receptacle. Thus it is likely that any sea water displaced into chamber 59 will be further displaced by convection induced circulation through grooves 60 and bore 55 into the upper portion of the female receptacle where it will disperse and where it will have no effect on the electrical integrity of the connector. The preferred flourocarbon dielectrics also have a low surface tension which enhances the aforementioned self cleansing features of the connector.

During disengagement of the male plug and female receptacle, dummy piston 41 is pushed forward by springs 43 as male pin 76 is withdrawn from cylinder 42. Sea water is again prevented from entering the female receptacle by the continuous wiping contact of O-ring 46 with the male pin and dummy piston as the male pin withdraws. If the male plug is maintained vertically aligned as it is disconnected, dense dielectric fluid will flow back out of concentric reservoir 93 and will surround the male pins. Male pins 76 will thus remain protected in an inert environment until the male plug is reconnected.

FIELD TESTS

A subsea, wet electrical connector was fabricated in accordance with the present invention as described in the above preferred embodiment. The subsea connector was then subjected to a two phase test program designed to establish and verify the connector's electrical and mechanical integrity.

Phase I Tests — The first phase of testing was performed at atmospheric pressure and consisted of electrical tests to prove the electrical integrity of the connector under both normal and abnormal operating conditions. The Phase I tests and test results were as follows:

(1) High Voltage Withstand — Each time this test was performed, an AC voltage of 50,000 volts AC RMS was applied for one minute between connector conductors and between each conductor and the connector shell. The test was conducted to verify the integrity of the connector high voltage design and to detect the presence of any faulty or damaged insulation. The test was successfully repeated over 100 times.

(2) Current Ampacity Test — Current was circulated through the mated connector continuously to determine full load operating capability. Currents of up to 300 amperes were tested without any overheating of the conductors.

(3) Simulated Full Load — Continuous high voltage and high current combinations were applied to test the connector's ability to simultaneously handle high currents and voltages. Combinations of 35 KV and 100 amperes, 35 KV and 200 amperes, and 35 KV and 300 amperes were successfully applied to the connector for five days.

(4) Corona Test — Under conditions of 50 KV RMS no noticeable traces of potentially destructive corona were detected in the connector.

(5) Basic Insulation Level Test — The connector was subjected to a 150 KV (1.5 × 40 microsecond waveform) voltage pulse designed to simulate a severe voltage transient caused, for example, by a lightning strike. The connector successfully survived the temporary voltage shock applied to it.

(6) Short Circuit Test — The connector successfully withstood simulated short circuit conditions involving currents of up to 2000 amperes for ten seconds.

Phase II Tests — The second phase of testing consisted of a combination of electrical and hydrostatic tests under conditions designed to simulate deep ocean conditions. Specifically, tests were performed in a water filled vessel pressurized at 2750 psig, thus simulating a water depth of about 5500 feet.

(1) Pressure Tests — Pressure was increased in increments of about 500 psi until the test pressure of 2750 psig was reached. At each pressurization step, the connector was mated and unmated. Following each mating and unmating, high voltage withstand and insulation resistance tests were performed to detect any water leakage into the connector. All tests indicated no water leakage occurred. Near the end of the test, the pressure was cycled four times between 100 psig and 2500 psig without any effect on the performance of the connector.

(2) Mating Test — Mating and unmating of the connector was repeated over 55 times without any adverse effects.

(3) High Voltage Test — During the pressure test the connector was subjected to one minute high voltage withstand tests of 40 KV after each mating and unmating operation. A constant energization of 30 KV was applied for two separate eight-hour periods. Throughout the tests, the connector maintained its electrical integrity.

(4) Insulation Resistance Test — During the pressure test the insulation resistance of the connector was checked following each mating and unmating operation. No noticeable degradation in the resistance readings was detected throughout the test, the resistance being relatively constant and greater than $10^{12}$ ohms.

The foregoing tests show that the subsea electrical connector of the present invention is capable of operating under conditions of high voltage (up to 35 KV) and high current (up to 300 amperes) and of withstanding pressures of up to 2750 psig with little or no adverse effects. The connector performed satisfactorily in all tests and demonstrated both mechanical and electrical integrity even when mated repeatedly under water.

It should be apparent from the foregoing that the apparatus of the present invention offers significant advantages over subsea electrical connectors previously known in the art. It will be appreciated that while the present invention has primarily been described with regard to the foregoing embodiments, numerous variations and modifications, including changes in size, shape and construction, may be made in the embodiments described herein without departing from the broad inventive concept hereinafter claimed.

We claim:

1. A subsea wet electrical connector comprising:
(a) a male plug having at least one male pin extending therefrom;
(b) a male contact mounted on the male pin;
(c) male conductor means for providing an electrical conducting path from an electrical cable entering the male plug to the male contact;
(d) a dielectric block within said male plug for insulating said male pin and male conductor;
(d) a female receptacle having therein at least one conductive cylinder means, each of said cylinder means corresponding to and adapted to receive each of said male pins;
(f) a female contact mounted within said conductive cylinder means which mates with the male contact when the male pin is inserted in the cylinder means and which provides an electrical conducting path from the male pin to the cylinder means;
(g) female conductor means for providing an electrical current path from an electrical cable entering the female receptacle to the cylinder means;
(h) nonconductive piston means mounted within the conductive cylinder means, said piston means being rearwardly displaced within the cylinder means when the male pin is inserted therein;
(i) resilient means for maintaining the piston means in an extended position within the cylinder means when the male pin is not inserted in the cylinder so that the piston means seals the entrance of the cylinder means and protects the female contact;
(j) a dielectric block within said female receptacle for insulating said female contact, said conductive cylinder means, and said female conductor, said dielectric block having passageways therein which provide a continuous circulatory flow path between the rear of said female receptacle and said conductive cylinder; and
(k) a dielectric fluid immiscible with sea water which fills the internal void spaces of said male plug and female receptacle and which convectively circulates through said passageways in the dielectric block so that heat is dissipated from the vicinity of said cylinder means.

2. The apparatus of claim 1 wherein said dielectric blocks are machined from polycarbonate.

3. The apparatus of claim 1 wherein said dielectric fluid is a liquid flourocarbon.

4. The apparatus of claim 1 which further includes pressure compensating means for equalizing the internal pressure of the dielectric fluid with the external pressure of the underwater environment.

5. The apparatus of claim 1 wherein said resilient means is a spring.

6. The apparatus of claim 1 which further includes seal means within the female receptacle which effectively seals the male pin when the male pin is inserted in the cylinder means.

7. The apparatus of claim 6 wherein said seal means is a floating glandular seal which sealingly engages said piston means when the male pin is not inserted in the cylinder means.

8. A subsea wet electrical connector comprising:
(a) a male plug having at least one male pin extending therefrom;
(b) a male contact mounted on the male pin;
(c) male conductor means for providing an electrical conducting path from an electrical cable entering the male plug to the male contact;
(d) a polycarbonate dielectric block within said male plug for insulating said male pin and male conductor;
(e) a female receptacle having therein at least one conductive cylinder, each of said cylinders corresponding to and adapted to receive each of said male pins;
(f) a female contact mounted within said cylinder which mates with the male contact when the male pin is inserted in the cylinder and which provides an electrical conducting path from the male pin to the cylinder;
(g) female conductor means for providing an electrical current path from an electrical cable entering the female plug to the conductive cylinder;
(h) a nonconductive piston mounted within the conductive cylinder, said piston being maintained in an extended position within the cylinder by a spring when the male pin is not inserted in the cylinder so that the piston seals the entrance of the cylinder and protects the female contact, said piston being rearwardly displaced within the cylinder when the male pin is inserted therein;

(i) a polycarbonate dielectric block within said female receptacle for insulating said female contact, conductive cylinder, and female conductor, said dielectric block having passageways therein which provide a continuous circulatory flow path between the rear of said female receptacle and said conductive cylinder; and (j) a dielectric flourocarbon liquid, which fills the internal void spaces of said male plug and female receptacle and which convectively circulates through said passageways in the dielectric block so that heat is dissipated from the vicinity of said cylinder.

9. The apparatus of claim 8 which further includes pressure compensating means for equalizing the internal pressure of the dielectric fluid with the external pressure of the underwater environment.

10. The apparatus of claim 8 which further includes seal means within the female receptacle which effectively seals the male pin when the male pin is inserted in the cylinder means.

11. The apparatus of claim 10 wherein said seal means is a floating glandular seal which sealingly engages said piston means when the mate pin is not inserted in the cylinder means.

* * * * *